US005655196A

United States Patent [19]

Litman et al.

[11] Patent Number: 5,655,196

[45] Date of Patent: Aug. 5, 1997

[54] WOUND MAGNETIC ROLL DEVELOPER TUBE AND METHOD OF MANUFACTURE

[75] Inventors: Alan M. Litman, Webster; Rafael Malespin, Rochester, both of N.Y.

[73] Assignee: Xerox Corporation, Stamford, Conn.

[21] Appl. No.: 653,892

[22] Filed: May 28, 1996

[51] Int. Cl.[6] ..... G03G 15/08

[52] U.S. Cl. ..... 399/276; 399/286; 29/895.211; 492/25

[58] Field of Search ..... 399/276, 286; 29/895.211, 895.3, 895.33; 156/307.3, 307.7; 492/25, 38, 48–52, 59

[56] References Cited

U.S. PATENT DOCUMENTS

| | | | |
|---|---|---|---|
| 3,616,046 | 10/1971 | Benzinger | 156/331 |
| 4,034,709 | 7/1977 | Fraser et al. | 118/658 |
| 4,278,733 | 7/1981 | Benzinger | 428/413 |
| 4,646,677 | 3/1987 | Lounsbury, Jr. et al. | 399/119 |
| 4,891,081 | 1/1990 | Takahashi et al. | 156/78 |
| 5,177,538 | 1/1993 | Mammino et al. | 355/259 |
| 5,245,392 | 9/1993 | Behe et al. | 355/259 |
| 5,300,339 | 4/1994 | Hays et al. | 428/36.9 |
| 5,378,525 | 1/1995 | Yamamoto et al. | 428/192 |
| 5,386,277 | 1/1995 | Hays et al. | 355/259 |
| 5,416,566 | 5/1995 | Edmunds et al. | 355/253 |
| 5,448,342 | 9/1995 | Hays et al. | 355/259 |
| 5,455,077 | 10/1995 | Yamamoto et al. | 427/425 |

*Primary Examiner*—Joan H. Pendegrass
*Attorney, Agent, or Firm*—John S. Wagley

[57] ABSTRACT

A developer roll for use in an electrophotographic printing machine of the type having an electrostatic latent image recorded on a photoconductive member in which a voltage differential is applied between the roll and a region adjacent the roll is provided. The developer roll includes a wound roll of media and a layer of resin. The wound roll is formed from a sheet of the media. The layer of resin is applied to the periphery of the wound roll. The layer of resin and the roll of media are selected of materials to obtain a decay rate relating to the electrical response of the layer of resin to the applied voltage differential.

33 Claims, 9 Drawing Sheets

WOUND MAGNETIC ROLL DEVELOPER TUBE AND METHOD OF MANUFACTURE

The present invention relates to a method and apparatus for developing a latent image. More specifically, the invention relates to a magnetic roll developer tubes for development systems.

The features of the present invention are useful in the printing arts and more particularly in electrophotographic printing. In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of jumping development. Jumping development consists of placing an alternating current bias between the donor roll/metering blade and the photoreceptor substrate. The alternating current on the donor roll/metering blade and the photoreceptor substrate causes the toner to jump from the donor roll to the latent image on the photoreceptor at the nip therebetween. A transition and back zone is formed in the nip where the toner moves to the photoreceptor and back to the donor roll. A second transition zone is formed immediately downstream of the transition and back zone in which toner moves to the photoreceptor in the image areas and in which toner moves from the photoreceptor to the donor roll in the non-image areas. Jumping development is disclosed in U.S. Pat. No. 4,292,387 the relevant parts thereof are incorporated herein by reference.

Another important variation to the general principle of development is the concept of "scavengeless" development. The purpose and function of scavengeless development are described more fully in, for example, U.S. Pat. No. 4,868,600 to Hays et al. U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; .or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

As stated earlier, development is typically accomplished by the use of a magnetic brush. The magnetic brush is typically formed by a developer roll which is typically in the form of a cylindrical sleeve which rotates around a fixed assembly of permanent magnets. When utilizing magnetic brush-type development, the cylindrical sleeve is typically made of an electrically conductive, non-magnetically conductive material, for example, aluminum.

When utilizing the jumping development and the (hybrid) scavengeless development described above, the developer roll typically includes a semi-conductive portion preferably on the periphery of the roll. The semi-conductive nature of the roll assists in the proper biasing of the roll with respect to the photoconductive surface onto which the toner is be deposited.

An electrically semi-conductive roll has typically been made of an aluminum shell with an anodizing coating placed upon the outside periphery of the aluminum roll. The semi-conductive properties of the anodized layer vary widely and are not easily predicted. Also, the anodized layer of aluminum has a tendency to wear rapidly.

Semi-conductive rolls have also been made utilizing an outer periphery of a phenolic. The phenolic is typically applied over a core of a conductive metallic material, for example, aluminum. The process of applying the phenolic material to the aluminum substrate is very expensive and time consuming.

Phenolic coated developing rolls have been made with two thermoset processes. These two thermoset processes are distinct. The first of these processes consists of extruding from phenolic material a free standing tube with a wall thickness of 0.02 to 0.04 inches. Subsequent to the extruding of the free standing tube, a metal tube is inserted into the inner periphery of the free standing tube at a secondary operation.

The second of the two thermoset extruding processes for manufacturing phenolic developing rolls is known as a cross head extrusion process. In this process, a metal tube is overcoated with a conductive phenolic coating during the extrusion process.

Both of these processes require an extensive amount of expensive equipment as well as expensive custom dies for each particular developer roll size. The extrusion process is further limited to a particular conductivity of the phenolic coating. Further, the developer roll utilizing this process will only have a decay rate corresponding to the above conductivity range of the phenolic coating. Also, the extruder typically can only manufacture one developer roll at a time through the extruder. The limitations of this process to only manufacture one roll at a time results in a slow, expensive process. Also, the core of a extruded developer roll must be rigid to accommodate the conforming resin.

The following disclosures may be relevant to various aspects of the present invention:

U.S. Pat. No. 5,455,077
Patentee: Yamamoto, et al.
Issue Date: Oct. 3, 1995

U.S. Pat. No. 5,448,342
Patentee: Hays, et al.
Issue Date: Sep. 5, 1995

U.S. Pat. No. 5,416,566
Patentee: Edmunds, et al.
Issue Date: May 16, 1995

U.S. Pat. No. 5,386,277
Patentee: Hays, et al.
Issue Date: Jan. 31, 1995

U.S. Pat. No. 5,378,525
Patentee: Yamamoto, et al
Issue Date: Jan. 3, 1995

U.S. Pat. No. 5,300,339
Patentee: Hays, et al
Issue Date: Apr. 5, 1994

U.S. Pat. No. 5,245,392
Patentee: Behe, et al.
Issue Date: Sep. 14, 1993

U.S. Pat. No. 5,177,538
Patentee: Mammino, et al.
Issue Date: Jan. 5, 1993

U.S. Pat. No. 4,891,081
Patentee: Takahashi, et al.
Issue Date: Jan. 2, 1990

U.S. Pat. No. 4,278,733
Patentee: Benzinger
Issue Date: Jul. 14, 1981

U.S. Pat. No. 4,034,709
Patentee: Fraser, et al.
Issue Date: Jul. 12, 1977

U.S. Pat. No. 3,616,046
Patentee: Benzinger, et al.
Issue Date: Oct. 26, 1971

U.S. Pat. No. 5,455,077 discloses a crowned resilient roll of continuously increasing diameter from the axially opposed ends. The resilient roll includes a columnar roll body formed of a resilient material and a coating layer formed on an outer circumferential surface of the roll body. The coating is applied to a rotating body with the speed of the rotating body being decreased in the middle of the roll.

U.S. Pat. No. 5,448,342 discloses a coated transport roll including a core with a coating of charge transporting molecules and an oxidizing agent dispersed in a resin. The transporting molecules includes aryldiamine molecules.

U.S. Pat. No. 5,416,566 discloses a magnetic roll assembly including a rotatable non-conductive shell surrounding a magnetic member to prevent eddy currents during rotation. The substrate has an elastomer coating formed thereon.

U.S. Pat. No. 5,386,277 discloses a coated toner transport roller including a core with a coating of an oxidized polyether carbonate.

U.S. Pat. No. 5,378,525 discloses a crowned resilient roll of continuously increasing diameter from the axially opposed ends. The resilient roll includes a columnar roll body formed of a resilient material and a coating layer formed on an outer circumferential surface of the roll body. A protective layer of N-methoxymethlated nylon is applied to the coating.

U.S. Pat. No. 5,300,339 discloses a coated toner transport roll containing a core with a coating of transporting molecules dispersed in a binder and an oxidizing agent of ferric chloride and/or trifluoroacetaic acid. The coating possesses a relaxation time of from about 0.0099 millisecond to about 3.5 milliseconds and a residual voltage of from about 1 to about 10 volts.

U.S. Pat. No. 5,245,392 discloses a donor roll for conveying toner in a development system. The roll includes a core of an electrically conductive material such as aluminum. The core is coated with a resin, for example a phenolic, to obtain a suitable conductivity to facilitate a discharge time constant of less than 300 microseconds.

U.S. Pat. No. 5,177,538 discloses a donor roll for a printer formed by mixing resin particles with conductive particles and subsequently extruding or centrifugal casting the mixture into a cylindrical shell. The shell is cut to the desired length and journals are attached to each end of the shell. The resin particles are thermoset particles preferably phenolic resin particles, and the conductive particles are preferably graphite particles.

U.S. Pat. No. 4,891,081 discloses a method of molding and a foamed resin molding in which a skin layer is formed by pressing an expandable film against and into conformity with cavity walls of a mold or a bag-like cover member by foaming pressure of a foamable resin and a foamed resin body molded concurrently and integrally under the skin layer.

U.S. Pat. No. 4,278,733 discloses a laminate product and method of making the same involving a base material such as cellulose fibrous materials impregnated with a cured mixture of aniline, phenol, formaldehyde and epoxy resin, which laminate has electrical and mechanical properties with improved heat resistance over previous materials.

U.S. Pat. No. 4,034,709 discloses a developer roll for a xerographic copier. The roll includes a tubular member made a non-magnetic metal for example aluminum. The roll is coated with a layer of styrene-butadiene. Magnets are disposed in the interior of the tubular member.

U.S. Pat. No. 3,616,046 discloses a laminated product possessing good physical and electrical properties made with an impregnating resin which is a reaction product of aniline, phenol and formaldehyde. These resins impart unusually good electrical and physical properties to the laminated product and are sufficiently water soluble as to allow their water content to be adjusted for direct, one stage impregnation of cellulose fiber materials such as paper.

In accordance with one aspect of the present invention, there is provided a developer roll for use in an electrophotographic printing machine of the type having an electrostatic latent image recorded on a photoconductive member in which a voltage differential is applied between the roll and a region adjacent the roll. The developer roll includes a wound roll of media and a resin. The wound roll is formed from a sheet of the media. The resin is applied to the periphery of the wound roll. The resin and the roll of media are selected of materials to obtain a decay rate relating to the electrical response of the roll to the applied voltage differential.

In accordance with another aspect of the present invention, there is provided a developer unit for use in an electrophotographic printing machine of the type having an electrostatic latent image recorded on a photoconductive member in which a voltage differential is applied between the unit and a region adjacent the unit. The developer unit includes a housing defining a chamber for storing a supply of toner particles therein and a developer roll for transporting the toner particles on a surface thereof from the chamber of the housing to the member. The developer roll further includes a wound roll of media. The wound roll is formed from a sheet of the media and a resin applied to the periphery of the wound roll. The resin and the roll of media are selected of materials to obtain a decay rate relating to the electrical response of the roll to the applied voltage differential.

In accordance with yet another aspect of the present invention, there is provided an electrographic printing machine of the type having an electrostatic latent image recorded on a photoconductive member in which a voltage differential is applied between the unit and a region adjacent the unit. The printing machine includes a housing defining a chamber for storing a supply of toner particles therein and a developer roll for transporting the toner particles on a surface thereof from the chamber of the housing to the member. The developer roll further includes a wound roll of media. The wound roll is formed from a sheet of the media and a resin applied to the periphery of the wound roll. The resin and the roll of media are selected of materials to obtain a decay rate relating to the electrical response of the roll to the applied voltage differential.

In accordance with a further aspect of the present invention, there is provided a method for manufacturing a developer roll for use in an electrophotographic printing machine of the type having an electrostatic latent image recorded on a photoconductive member in which a voltage differential is applied between the unit and a region adjacent the unit. The method includes the steps of forming a media including filaments into a sheet, impregnating the media with a resin wherein the resin and the roll of media are selected of materials to obtain a decay rate relating to the electrical response of the layer of the roll to the applied voltage differential, and rolling the sheet around the periphery of a mandrel.

BRIEF DESCRIPTION OF THE DRAWINGS

The invention will be described in detail herein with reference to the following figures in which like reference numerals denote like elements and wherein:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims, For a general understanding of the illustrative electrophotographic printing machine incorporating the features of the present invention therein, reference is made to the drawings. In the drawings, like reference numerals have been used throughout to designate identical elements. FIG. 3 schematically depicts the various components of an electrophotographic printing machine incorporating the developing device of the present invention therein. Although the developing device of the present invention is particularly well adapted for use in the illustrative printing machine, it will become evident that the developing device is equally well suited for use in a wide variety of printing machines and are not necessarily limited in its application to the particular embodiment shown herein.

Referring now to FIG. 3, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 20 rotates drum 16 to advance drum 16 in the direction of arrow 18. Drum 16 is coupled to motor 20 by suitable means such as a drive.

Figure 1:
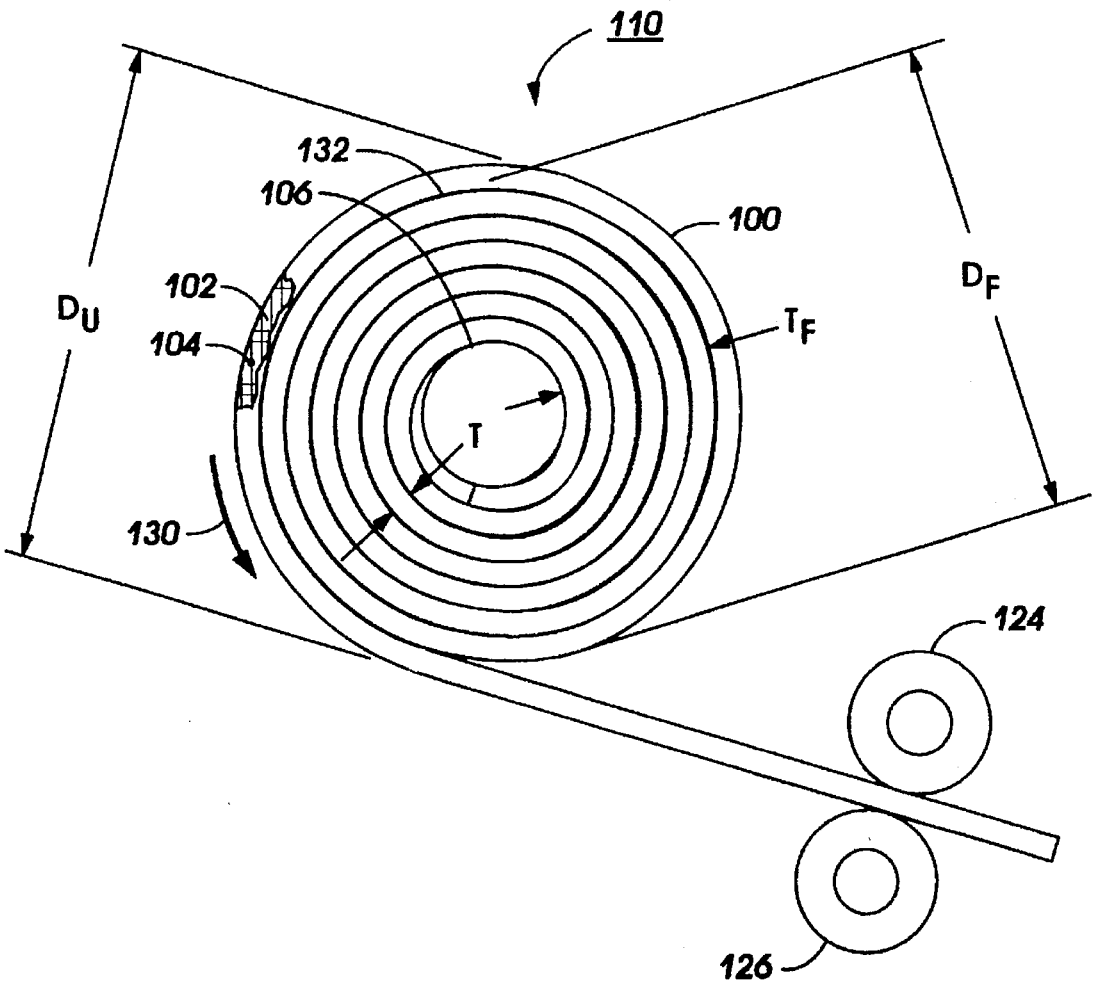
FIG. 1 is a plan view of a first embodiment of the wound developer roll according to the present invention.

Initially successive portions of drum 16 pass through charging station A. At charging station A, a corona generating device, indicated generally by the reference numeral 30, charges the drum 16 to a selectively high uniform electrical potential, preferably negative. Any suitable control, well known in the art, may be employed for controlling the corona generating device 30.

A document to be reproduced is placed on a platen 22, located at imaging station B, where it is illuminated in known manner by a light source such as a tungsten halogen lamp 24. The document thus exposed is imaged onto the drum 16 by a system of mirrors 26, as shown. The optical image selectively discharges surface 28 of the drum 16 in an image configuration whereby an electrostatic latent image 32 of the original document is recorded on the drum 16 at the imaging station B.

At development station C, a magnetic development system or unit, indicated generally by the reference numeral 36 advances developer materials into contact with the electrostatic latent images. Preferably, the magnetic developer unit includes a magnetic developer roller mounted in a housing. Thus, developer unit 36 contains a magnetic roller 40. The roller 40 advances toner particles into contact with the latent image. Appropriate developer biasing is may be accomplished via power supply 42, electrically connected to developer unit 36.

The developer unit 36 develops the charged image areas of the photoconductive surface. This developer unit contains magnetic black toner, for example, particles 44 which are charged by the electrostatic field existing between the photoconductive surface and the electrically biased developer roll in the developer unit. Power supply 42 electrically biases the magnetic roll 40.

A sheet of support material 58 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station F. The vacuum assisted, electrostatic, brush cleaner unit 70 is disposed at the cleaner station F. The cleaner unit has two brush rolls that rotate at relatively high speeds which creates mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
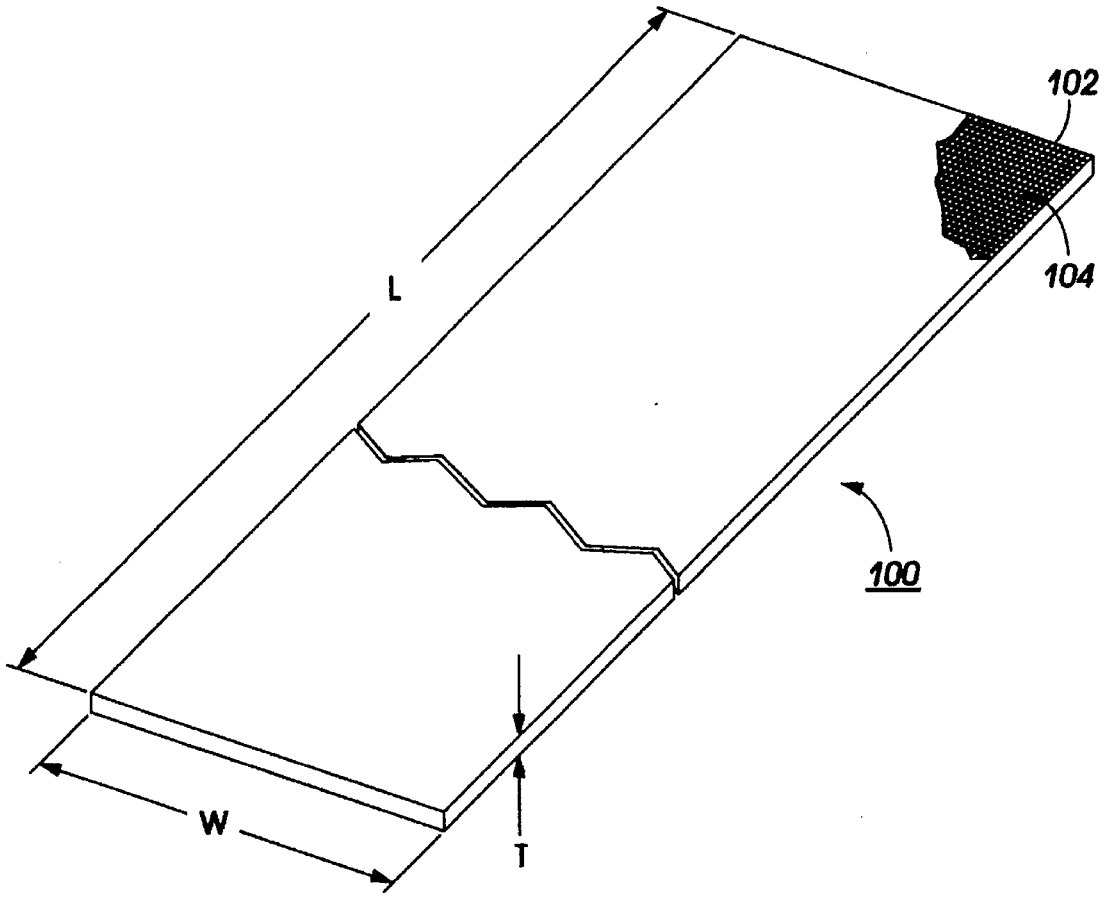
FIG. 2 is perspective view of a sheet of media for use in the wound developer roll of FIG. 1.

According to the present invention and referring to FIG. 2, a conductive sheet 100 is shown for use in manufacturing the wound magnetic roll developer tube of the present invention. The sheet 100 of media is made from a media 102 which may be any suitable material capable of absorbing a resin 104. Any wrapable or windable media can be used. For example, the media 102 may be a woven fiber cloth or a paper. For example, the paper may be a Kraft paper. The paper or cloth or other suitable media may be impregnated with a conductive material, for example, carbon fibers.

The resin 104 may be any suitable thermoset or thermoplastic resin. For example, the thermoset resins may include phenolics or epoxies. The resins may be conductive or semi-conductive. The level of conductivity/resistivity of the resin may be controlled by the amount or type of additive to the phenolic material.

While the invention is preferably practiced with a sheet of media 100, it should be appreciated that the invention may be practiced utilizing a filament winding process. Filament winding is the process of wrapping resin-impregnated continuous fiber windings around a suitable mold or mandrel to produce a finished product. This process will be described in greater detail later.

The media 102 may be conductive or non-conductive, while the resin 104 may be conductive or semi-conductive. The combination of varying the conductivities of both the media 102 and the resin 104 permits a wide range and reasonably tight control of the conductivity/resistivity of the sheet of media 100.

The sheet of media 100 may have any particular size depending on the size of the developer roll to manufactured. For example, for a developer roll having a length L, the sheet of media preferably has a length L roughly identical to the length of the roll. To permit the copying of a sheet of 8½"×11" piece of paper both lengthwise and crosswise, the length L is typically slightly larger than 11 inches. The sheet of media 100 is wound into cylindrical roll and therefore has a predetermined width W which may be described by the following:

$$W=C\times N_F+C\times N_M$$

where:

C=the circumference of the roll;

$N_F$=the number of layers of the sheet of media in the finished developer roll; and $N_M$=the number of windings of the sheet of media which are subsequently removed in the machining process.

The sheet of media 100 may have any suitable thickness, but the applicants have found that a sheet of media 100 having thickness T of approximately 0.004 to 0.007 inches performs satisfactorily. For the thickness of the media 102 of 0.004 to 0.007 inches, the sheet when impregnated with resin 104 has an impregnated thickness of approximately 0.006 to 0.010 inches.

Referring now to FIG. 1, sheet of media 100 is shown wound about mandrel 106. The mandrel 106 may have any suitable shape suitable for winding the sheet of media 100 into roll 110 of media. Preferably the mandrel 106 has a cylindrical shape is made of a suitable, durable material, for example, steel or aluminum. The resistivity of sheet of media 100 is probably selected to obtain the proper operating conditions. For example, for a semi-conductive developing roll, the resin 104 and media 102 are selected to have a resistivity from $10^1$ to $10^9$ ohms.

Figure 2A:
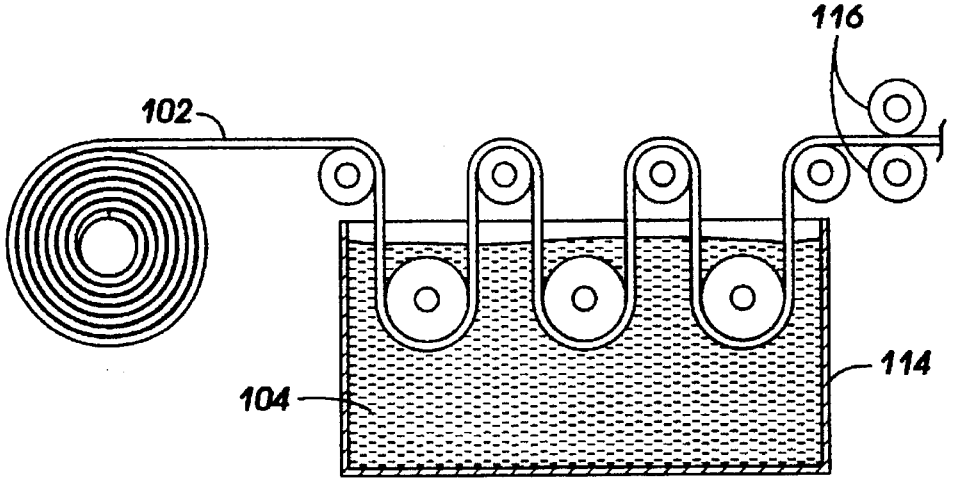
FIG. 2A is schematic elevational view of a process for manufacturing a sheet of media for use in the wound developer roll of FIG. 1.
Figure 3:
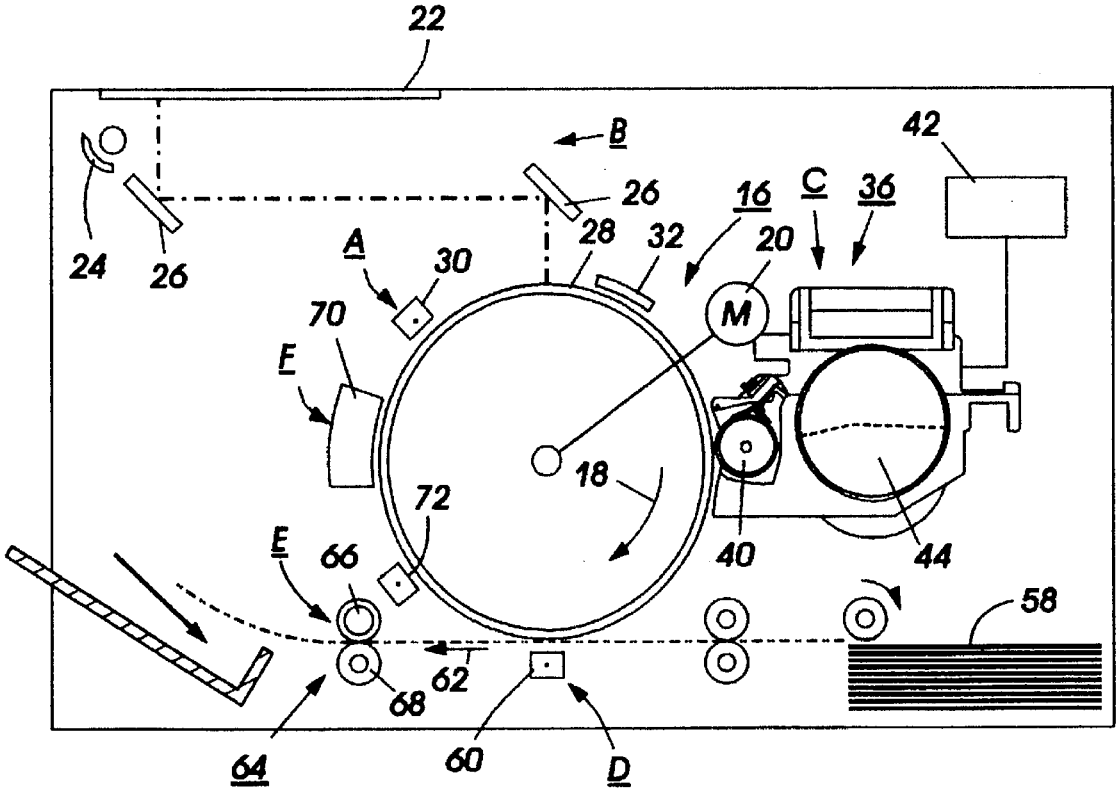
FIG. 3 is a schematic elevational view of an illustrative electrophotographic printing machine incorporating the wound developer roll of the present invention therein.

Referring now to FIG. 2A, a process for applying resin 104 into the media 102 is shown. It should be appreciated that other coating operations or methods including but not limited to dipping or spraying may be used The resin 10 is stored in a tank 114. The media 102 is fed into the tank 114 with the media 102 being submersed within the resin 104 in the tank 114. The sheet 100 may be permitted to be raised and lowered above and below the level of the media 102 to permit partial drying of the resin 104 within the media 102. To obtain a constant thickness for the sheet of media 100, the sheet of media 100 may be squeezed between a set of rolls 116 upon exit from the tank 114.

After the coating operation, the sheet 100 of media is partially cured and chemically cross-linking the resin. The roll 100 is processed to a "B" stage which is dry to the touch, not tacky and not fully cured.

Referring again to FIG. 1, the "B" stage sheet 100 is wrapped about mandrel 106 to form roll 110 of media. The sheet 100 is fed between a set of rolls 122 including a heated roll 124 and a pressure roll 126. It should be appreciated that heat may be added to sheet 100 in any suitable way such as by induction heating, or conduction or convection heating the sheet 100 directly. The mandrel 106 is rotated in the direction of arrow 130 to permit the sheet 100 to wrap about the mandrel 106. The rotational velocity of the mandrel 106 and the linear velocity of the sheet 100 entering the mandrel 106 are controlled to provide for the proper tension upon the sheet 100 to properly form the roll 110 of media.

The mandrel 106 has an unfinished diameter $D_U$ which is of sufficient size to provide for a finished diameter $D_F$ of the roll 110 as well as a thickness $T_F$ of the roll. The applicants have found that for a roll with a finished diameter $D_F$ of approximately 0.8 inches, the mandrel preferably has a diameter of 0.75 inches. The finished thickness $T_F$ of the roll in this case is approximately 0.025 inches. For a sheet 100 with a thickness T of approximately 0.006 inches, this represents four revolutions or wraps of the sheet 100 about mandrel 106. To permit subsequent machining of the roll 110, the unfinished roll diameter $D_U$ prior to machining is substantially larger than the finished roll diameter $D_F$ of the roll 110. Applicants have found that an unfinished roll diameter $D_U$ of approximately 0.80 inches is sufficient for use with a finished diameter $D_F$ of approximately 0.75 inches. When using a sheet 100 with a thickness T of approximately 0.006 inches, the sheet 100 has four revolutions of wraps about mandrel 106 to accommodate the portion of the roll 110 which is machined away in a subsequent operation. The heating of the sheet 100 with heated roll 124 serves to fuse the outer edge or seam 132 of the roll 110.

Figure 4:
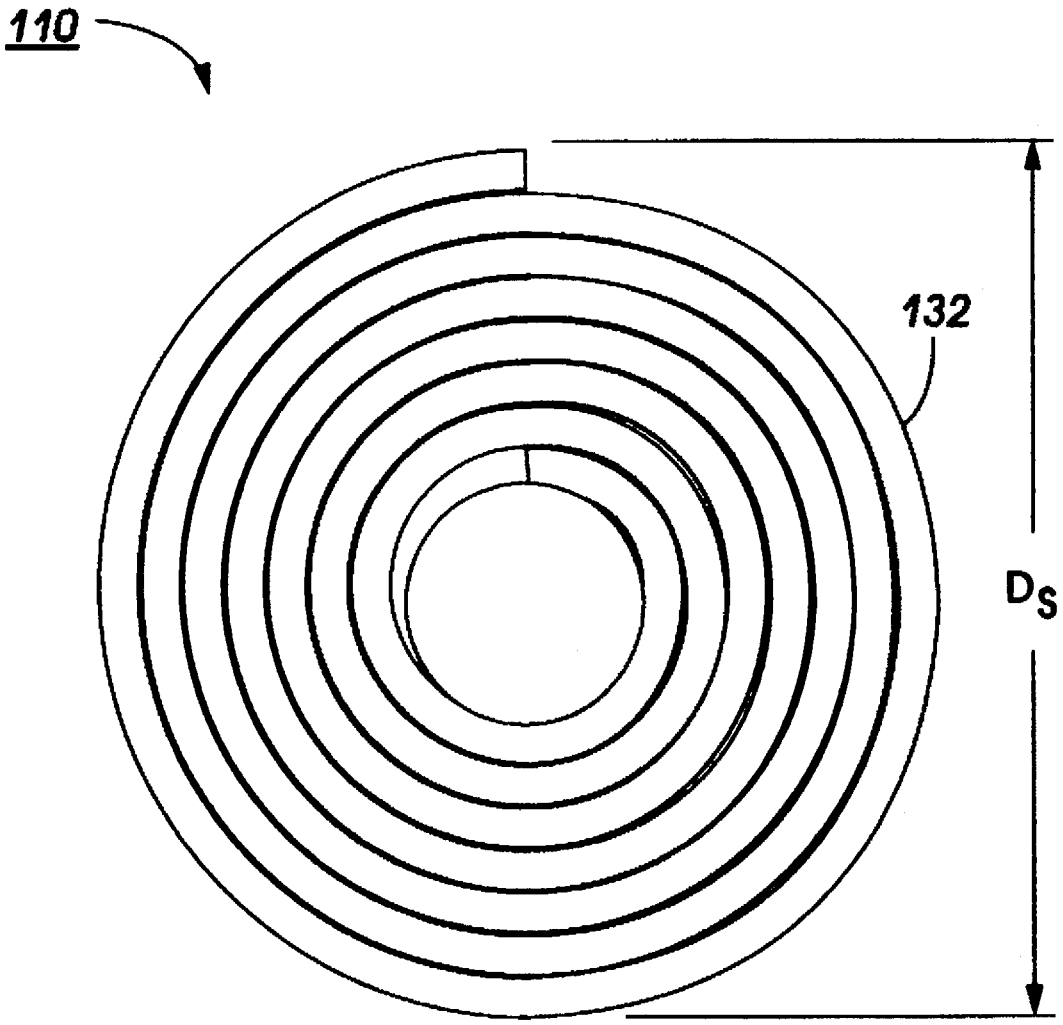
FIG. 4 is a end view of a second embodiment of a developer roll according to the present invention having a internal core.

Referring now to FIG. 4, the roll 110 is shown subsequent to machining. For a roll with a finished diameter $D_F$ of approximately 0.80 inches wound about a mandrel with unfinished diameter $D_U$ (see FIG. 1) of 0.75 inches, the sheet 100 is wound about approximately four revolutions. Each of the layers of the sheet have a thickness of approximately 0.006 inches. Seam 132 is formed at the periphery of roll 110. Roll 110 is shown with mandrel 106 (see FIG. 1) removed therefrom.

While the invention may be practiced with roll 110 consisting essentially of the roll 110 of media, the invention may be alternatively practiced with the mandrel serving also as a core for the roll. The use of the mandrel as a core will tend to strengthen the roll and if the mandrel is made from an electrically conductive material, the mandrel may serve to conduct an electrical bias to the roll.

Figure 5:
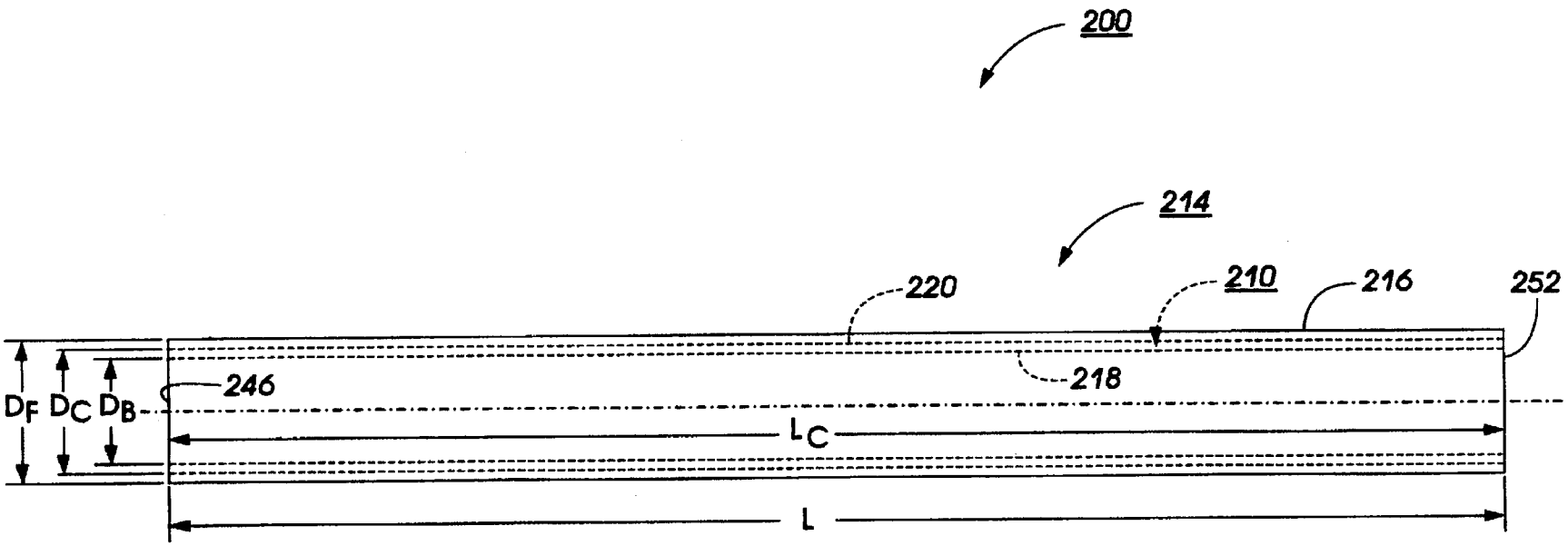
FIG. 5 is a plan view of the FIG. 4 developer roll.
Figure 8:
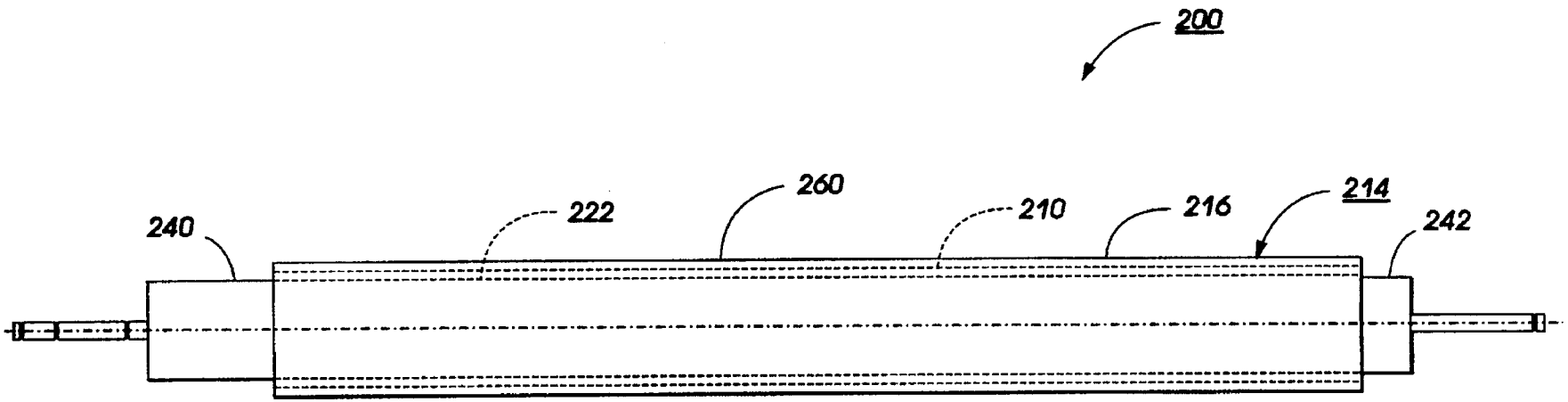
FIG. 8 is a plan view of a developer roll assembly utilizing the roll of FIG. 5, the magnet of FIG. 6 and the end caps of FIGS. 7A and B.

For example, referring to FIG. 8, developer roll 200 is shown. The developer roll 200 includes sleeve 214. Sleeve 214 includes core 210 as well as resin impregnated tube 216 which is located on core 210. Tube 216 is similar to developer roll 110 of FIG. 4. Tube 216 of FIG. 5 is constructed of similar materials in a similar fashion to roll 110 of FIG. 4. The core 210 serves as the mandrel, as in mandrel 106 of FIG. 1.

The core 210 may be made of any suitable, durable material, but preferably is made of an electrically conductive material, for example, a metal. Preferably, the core 210 is made of a non-magnetic metal, for example, aluminum. The core may add any suitable shape, but preferably has a cylindrical shape. The core 210 may be solid, but for use with a roller for magnetic brush development, the core 210 is hollow. The core 210 has a length $L_C$ approximately equal to the length L of the roll 200. The core 210 has bore diameter $D_B$ which is slightly smaller than core diameter $D_C$ of outer periphery 220 of the core 210. The core diameter $D_C$ is sufficiently larger than the bore diameter $D_B$ of bore 218 to provide adequate stiffness for the developer roll 200. For example, for a developer roll 200 having a bore 218 with bore diameter $D_B$ of approximately 0.70 inches, the core diameter $D_C$ of the core 210 is approximately 0.75 inches for a core 210 made of aluminum.

Applicants have found that with the use of a core 210 with a core diameter $D_C$ of approximately 0.75 inches, finished diameter $D_F$ of the sleeve 214 of approximately 0.80 inches is acceptable.

Figure 6:
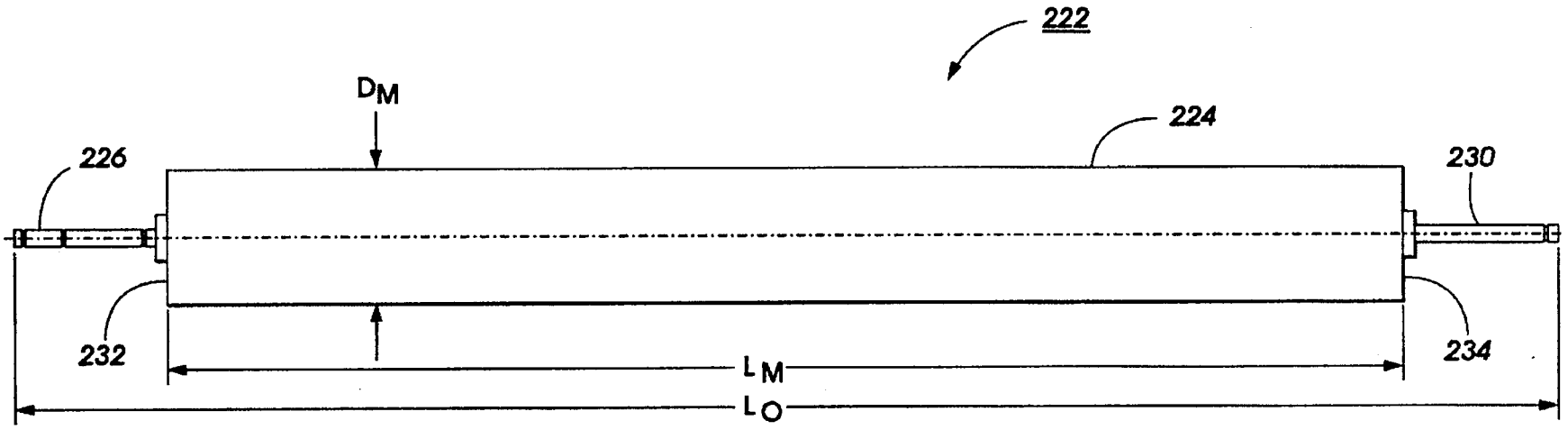
FIG. 6 is a plan view of a magnet for use with the developer roll of FIG. 4.

Referring now to FIG. 6, a magnet 222 for use with the sleeve 214 (see FIG. 5) is shown in FIG. 6. The magnet 222 may have any suitable shape, but preferably has a cylindrical body 224 as well as first and second stems 226 and 230, respectively, which extend outwardly from first and second ends 232 and 234, respectively, of the body 224. The body 224 is made of any material having a ferromagnetic property and preferably is made of a permanent magnet material. The first and second stems 226 and 230 are made of any suitable, durable material, for example, steel. The body 224 has a body diameter $D_M$ which is slightly smaller than the bore diameter $D_B$ of the bore of the sleeve 214 (see FIG. 5). Body 224 is thus able to rotate within the sleeve 214.

The body 224 has a length $L_M$ which is smaller than length $L_S$ of the sleeve 214. The magnet 222 has a overall length Lo which is significantly than length $L_S$ of the sleeve 214 (see FIG. 5).

Figure 7A:
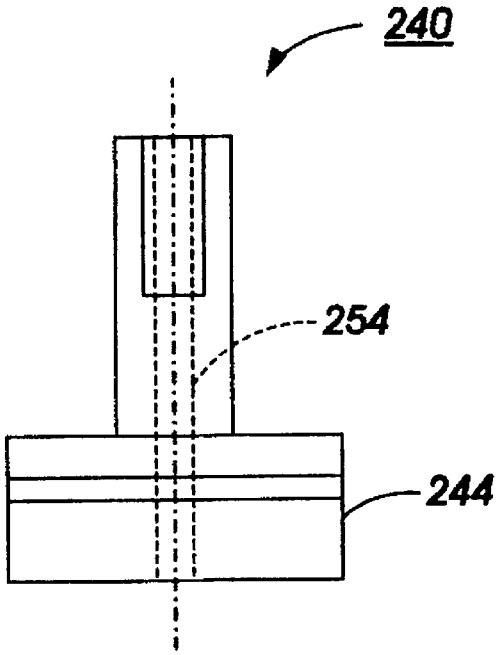
FIG. 7A is a plan view of a first end cap for containing the magnet of FIG. 6 within the roll of FIG. 5.
Figure 7B:
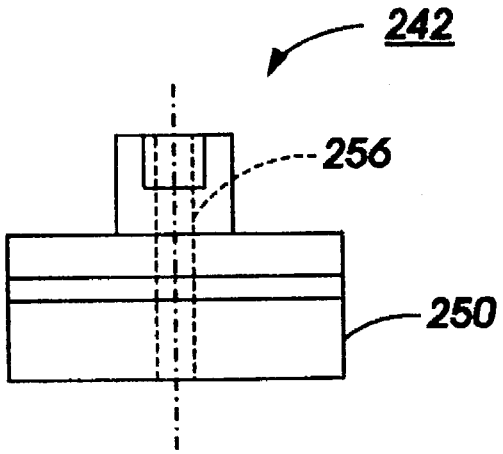
FIG. 7B is a plan view of a second end cap for containing the magnet of FIG. 6 within the roll of FIG. 5.

Referring now to FIGS. 7A and 7B, plugs 240 and 242 are shown. First and second plugs 240 and 242, respectively, serve to support the magnet 222 and permit the magnet 222 to rotate within the sleeve 214 (see FIG. 5). The first plug 240 includes outer diameter 244 which is fitted within bore 218 of the sleeve 214 at first end 246 of sleeve 214 (see FIG. 5). Similarly, second plug 242 includes outer diameter 250 which is fitted to bore 218 of sleeve 214 at second end 252. First plug 240 further includes a first plug bore 254 to which stem 226 is slidably located. Similarly, the second plug 242 includes second plug bore 256 to which second stem 230 is slidably fitted. First plug and second plug, 240 and 242, respectively, are made of any suitable, durable material capable of performing the desired functions of the roll 200. Preferably, first plug and second plug 240 and 242 are made of a magnetically non-conductive material. Further, the first and second plugs 240 and 242 are preferably made of an electrically conductive material to transmit an electrical bias from the plugs 240 and 242 to the core 210 of the sleeve 214 (see FIG. 5). Aluminum is a suitable magnetic non-conductor and electrical conductor and is suitable for this application.

Referring again to FIG. 8, developer roll 200 is shown with the magnet 222 installed within sleeve 214. Plugs 240 and 242 provide the support for magnet 222 within the sleeve 214.

Electrical bias is applied to the plugs 240 and 242 and passes through core 210 of sleeve 214 and through the resin impregnated tube 216 to the periphery 260 of the developer roll 200.

Figure 9:
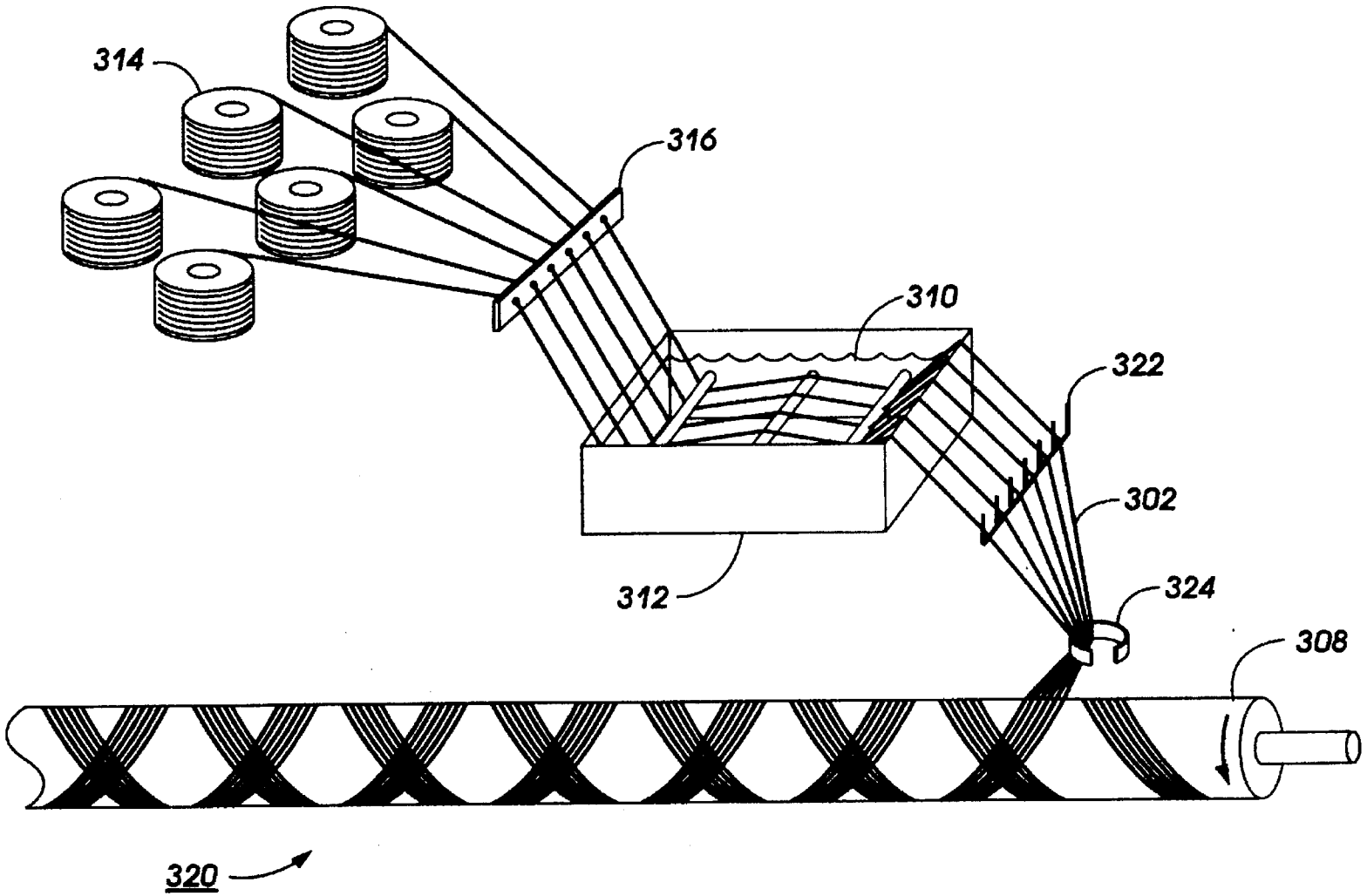
FIG. 9 is schematic elevational view of an alternate developer roll according to the present invention and a process for manufacturing this developer roll.

Referring now to FIG. 9, an alternate process for making a resin impregnated tube according to the present invention is shown in FIG. 9. Mandrel 308 is similar to mandrel 118 of FIG. 1. Roll 320 of media of FIG. 9 is similar to roll of media 120 of FIG. 1, except that media 102 of FIG. 2 which is made of paper is replaced by non-conductive filaments 302. The filaments may be made of any suitable material, for example carbon/graphite or glass. The filaments may be made of glass. In this process, the glass filaments 302 are coated with liquid resin 310 located in resin bath 312. The glass filaments 302 are fed from glass creels 314 through a glass guide 316 into the resin bath 312. From the resin bath 312, the glass filaments 302 which now are coated with resin 310 are separated through a comb or eyelet 322 and are finally gathered together by yoke 324 and twisted about mandrel 308. The mandrel 308 rotates while the filaments 302 are fed through the yoke 324 while the yoke 324 moves up and down the length of the mandrel 308. The mandrel is then treated and the part is cured. The molded parts may require oven curing. Impregnated and partially cured reinforcing tapes may also used for filament windings. These are commonly used for products of unusual shapes.

By providing a developer roll according to the present invention with a wound magnetic roll developer tube, a developer tube that only requires low cost tooling including a mandrel, is provided.

By providing a wound magnetic roller including media and resin which media and resin can both be modified to provide various conductivity ranges, a developer roll can be provided with a widely varied and accurately maintained conductivity range.

By providing a wound magnetic roll developer tube with controllable conductivity resins and controllable conductivity media, a developer roll with an accurate, specific decay rate can be provided.

By providing a wound magnetic roll developer tube which may be wound about a mandrel, many parts may be simultaneously manufactured at one time.

By providing a wound magnetic roll developer tube, various conductive mediums including paper, wound fabrics, fillers, and non-conductive filaments can be used to provide the developer tube.

By utilizing wound magnetic roll developer tools, a wide variety of resins can be used which have a wide range of conductivity and decay rates. These materials may include thermoset resins such as phenolics, polyesters and epoxies as well as thermoplastics.

By providing a wound magnetic roll developer tube, a roll can be provided with a specific decay rate which may be used as a donor roll for hybrid scavengeless development or for jumping development.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A developer roll for use in an electrophotographic printing machine of the type having an electrostatic latent image recorded on a photoconductive member in which a voltage differential is applied between the roll and a region adjacent the roll, said developer roll comprising:

a wound roll of media, said wound roll formed from a sheet of the media; and a resin at least partially absorbed by the periphery of said wound roll, said layer of resin and said roll of media being selected of materials to obtain a decay rate relating to the electrical response of the roll to the applied voltage differential.

2. The developer roll as in claim 1, further comprising a core, said wound roll located on a periphery of said core.

3. The developer roll as in claim 2, wherein said core comprises a metal.

4. The developer roll as in claim 1, wherein said layer has a conductivity of $10^5$ to $10^7$ ohms.

5. The developer roll as in claim 1, wherein said layer comprises a conductive material.

6. The developer roll as in claim 5, wherein said conductive material comprises a thermoset resin.

7. The developer roll as in claim 1, wherein the sheet of media has a thickness of 0.001 to 0.008 inches.

8. The developer roll as in claim 1, wherein the sheet of media is wrapped at least 360 degrees.

9. The developer roll as in claim 1, wherein the media comprises woven cloth.

10. The developer roll as in claim 1, wherein the media comprises carbon.

11. A developer unit for use in an electrophotographic printing machine of the type having an electrostatic latent image recorded on a photoconductive member in which a voltage differential is applied between the unit and a region adjacent the unit, the developer unit comprising:

a housing defining a chamber for storing a supply of toner particles therein; and a developer roll for transporting the toner particles on a surface thereof from the chamber of the housing to the member, the developer roll including a wound roll of media, said wound roll formed from a sheet of the media and a resin at least partially adsorbed by the periphery of said wound roll, said resin and said roll of media being selected of materials to obtain a decay rate relating to the electrical response of the roll to the applied voltage differential.

12. The developer unit as in claim 11, further comprising a core, said wound roll located on a periphery of said core.

13. The developer unit as in claim 12, wherein said core comprises a metal.

14. The developer unit as in claim 11, wherein said layer has a conductivity of $10^5$ to $10^7$ ohms.

15. The developer unit as in claim 11, wherein said layer comprises a conductive material.

16. The developer unit as in claim 15, wherein said conductive material comprises a thermoset resin.

17. The developer unit as in claim 11, wherein the sheet of media has a thickness of 0.001 to 0.008 inches.

18. The developer unit as in claim 11, wherein the sheet of media is wrapped at least 360 degrees.

19. The developer unit as in claim 11, wherein the media comprises woven cloth.

20. The developer unit as in claim 11, wherein the media comprises carbon.

21. An electrophotographic printing machine of the type having an electrostatic latent image recorded on a photoconductive member in which a voltage differential is applied between the unit and a region adjacent the unit, the printing machine comprising:

a housing defining a chamber for storing a supply of toner particles therein; and a developer roll for transporting the toner particles on a surface thereof from the chamber of the housing to the member, the developer roll including a wound roll of media, said wound roll formed from a sheet of the media and a resin at least partially absorbed by the periphery of said wound roll, said layer of resin and said roll of media being selected of material to obtain a decay rate relating to the electrical response of the roll to the applied voltage differential.

22. The printing machine as in claim 21, further comprising a core, said wound roll located on a periphery of said core.

23. The printing machine as in claim 22, wherein said core comprises a metal.

24. The printing machine as in claim 21, wherein said layer has a conductivity of $10^5$ to $10^7$ ohms.

25. The printing machine as in claim 21, wherein said layer comprises a conductive material.

26. The printing machine as in claim 25, wherein said conductive material comprises a thermoset resin.

27. The printing machine as in claim 21, wherein the sheet of media has a thickness of 0.001 to 0.008 inches.

28. The printing machine as in claim 21, wherein the sheet of media is wrapped at least 360 degrees.

29. The printing machine as in claim 21, wherein the media comprises woven cloth.

30. The printing machine as in claim 21, wherein the media comprises carbon.

31. A method for manufacturing a developer roll for use in an electrophotographic printing machine of the type having an electrostatic latent image recorded on a photoconductive member in which a voltage differential is applied between the unit and a region adjacent the unit, said method comprising the steps of:

forming a media including filaments into a sheet;

impregnating the media with a resin wherein the resin and the roll of media are selected of materials to obtain a decay rate relating to the electrical response of the roll to the applied voltage differential; and rolling the sheet around the periphery of a mandrel.

32. The method of claim 31, further comprising the step of machining the periphery of the rolled sheet.

33. The method of claim 31, further comprising the step of removing the mandrel from the rolled sheet.

* * * * *